US005806099A

United States Patent [19]

Grinberg

[11] Patent Number: 5,806,099

[45] Date of Patent: Sep. 15, 1998

[54] DISPOSABLE GLOVE OR MITT

[75] Inventor: Dan Grinberg, New York, N.Y.

[73] Assignee: Island Polyethylene Bag & Supply Corp., Westbury, N.Y.

[21] Appl. No.: 956,205

[22] Filed: Oct. 22, 1997

[51] Int. Cl.[6] ..... A41D 19/01

[52] U.S. Cl. ..... 2/158; 2/159; 2/161.6

[58] Field of Search ..... 2/158, 159, 161.6, 2/161.7, 162, 168, 167, 169, 16

[56] References Cited

U.S. PATENT DOCUMENTS

| | | | |
|---|---|---|---|
| 2,325,482 | 7/1943 | Curran | 2/159 |
| 2,773,264 | 12/1956 | Nover | 2/159 |
| 4,017,907 | 4/1977 | Margolis | 2/158 |
| 4,476,588 | 10/1984 | Long | 2/159 |
| 4,677,697 | 7/1987 | Hayes | 2/169 |
| 4,718,125 | 1/1988 | Derda et al. | 2/158 |
| 4,845,781 | 7/1989 | Strickland et al. | 2/161.6 |
| 4,928,322 | 5/1990 | Bradfield | 2/158 |
| 5,020,159 | 6/1991 | Hellickson | 2/158 |
| 5,020,160 | 6/1991 | Cano | 2/158 |
| 5,186,322 | 2/1993 | Harreld et al. | 2/159 |
| 5,575,014 | 11/1996 | Kane et al. | 2/161.6 |

*Primary Examiner*—Amy B. Vanatta
*Attorney, Agent, or Firm*—Schweitzer Cornman Gross & Bondell LLP

[57] ABSTRACT

A disposable mitt has a mitt body formed of front and back layers of plastic sealed around the periphery thereof forming a closed end and an open end and forming a thumb portion and one or more finger portions. A detachable section extends from the back layer adjacent the open end of the mitt body and has a line of weakness, such as perforation, suitable for separation of the detachable portion from the mitt body. The detachable portion also includes means to mount the mitt assembly on a support structure, such as a wicket. A cuff, attached to the front layer of the mitt body adjacent the open end, extends forwardly and is open toward the closed end of the mitt body. The cuff is adapted to be grasped by the free hand of the user for enlarging the open end of the mitt to assist in donning the mitt body either before or after separation of said mitt body from the detachable section.

3 Claims, 1 Drawing Sheet

DISPOSABLE GLOVE OR MITT

FIELD OF THE INVENTION

The invention pertains to disposable mitts or mitts suitable for use in the food service and handling industries or the like.

BACKGROUND AND SUMMARY OF THE INVENTION

Disposable hand covers such as mitts or gloves are widely used in the food handling and service industries, as well as other applications to provide protection and to insure hygiene. Typically, disposable mitts and mitts are formed of one or more layers of plastic film sealed around their periphery, forming a mitt. Mitts typically have separate and distinct portions for each finger, while mitts typically have one portion for the thumb and a single, separate portion for the four fingers. However, for the purposes of the following disclosure, it is intended that the term mitt include such gloves.

In many applications, including the food handling and service industries, it can be required that personnel change mitts relatively frequently. Typically, after each use, the disposable mitt is thrown away and a new mitt is put on. It is obvious therefore, that it is desirable that the disposable mitts be inexpensive. However, it is also desirable that the mitt be designed such that it can be easily and quickly put on with a minimum effort and without contaminating or compromising the cleanliness of the new mitt or of the personnel.

One known method to organize and assist in the donning of disposable mitts is the use of a so-called wicket. Wickets, which are also commonly used with disposable sandwich and grocery bags and the like, typically consists of two usually vertical rods which extend through holes in tear-off portions of the items. In this manner, items can be conveniently stored next to a workstation, stacked on the wicket and can be relatively easily selected by separating the usable portion from the tear-off portion. However, when mitts are stacked on a wicket, the mitts can be difficult to grasp and put on, especially when one is trying to put on two such disposable mitts.

Therefore, what is desired is an inexpensive, disposable mitt which is stackable on a wicket or other holding system and which provides an easy and hygienic means to don the mitt.

The present invention is an inexpensive, disposable mitt formed of two sheets of plastic film typically heat or radio frequency sealed around the peripheral edges thereof and forming separate portions for the thumb and fingers. At the open end of the mitt, the back sheet extends beyond the front or palm sheet and includes a tear-off portion with holes therein suitable for mounting on a wicket, or the like. The front or palm sheet includes a cuff adjacent the tear-off portion. The cuff extends forwardly toward the closed end of the mitt and forms a small pocket which can be easily grasped to open the mitt to aid in the insertion of the opposite hand therein.

Additional features and advantages of the invention will be apparent from the description and claims below when read in conjunction with the attached drawings.

DETAILED DESCRIPTION OF THE INVENTION

Figure 1:
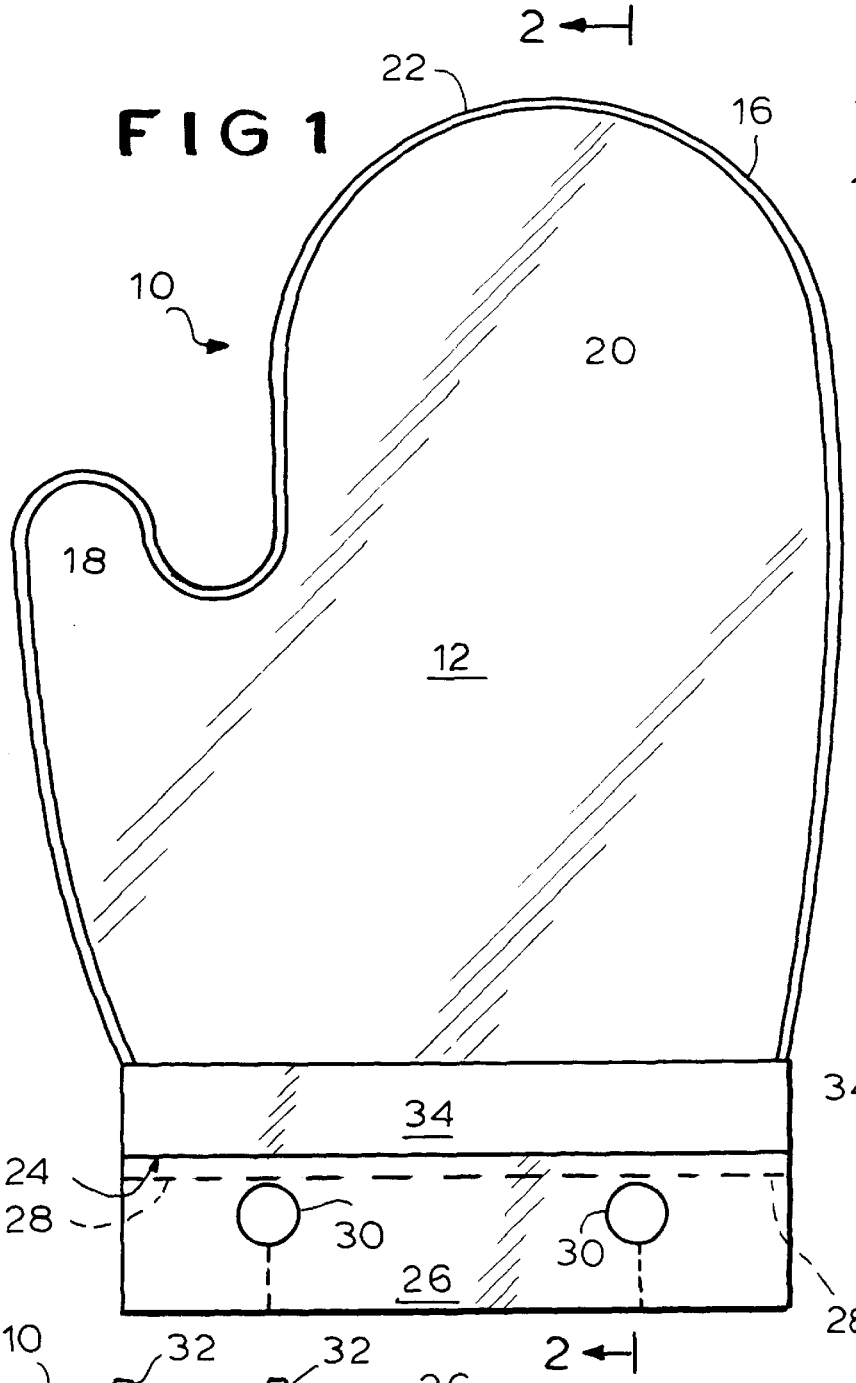
FIG. 1 is a top, plan view of the disposable mitt of the present invention.
Figure 2:
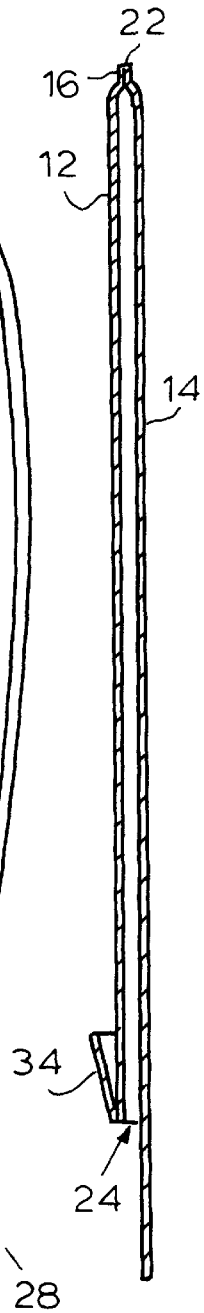
FIG. 2 is a cross sectional, side elevational view taken along line 2—2 of FIG. 1.
Figure 3:
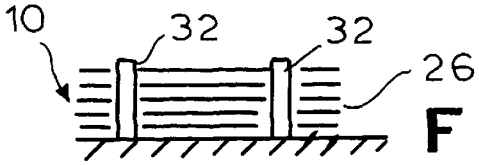
FIG. 3 is a schematic representation of a plurality of mitts made in accordance with the present invention stacked on a wicket device.

Referring to FIGS. 1–3, the disposable mitt or glove of the present invention includes a front, or palm-side sheet of plastic 12 sealed to a back sheet of plastic 14. The front and back sheets 12, 14 are preferably heat or radio frequency sealed around the periphery 16 thereof forming a mitt or glove shape having a thumb portion 18, at least one finger portion 20, a closed end 22 and an open end 24.

As best seen in FIG. 2, the back sheet 14 extends beyond the front sheet 12 at the open end 24 forming a detachable tear-off portion 26 separated from the body of the disposable mitt 10 by a line of perforation 28, or other suitable line of weakness. The tear-off portion 26 includes holes 30 suitable for mounting on the rods 32 of a wicket for stacking and organizing the disposable mitts 10. Thus, to remove a mitt 10 from the wicket 32, the body of the disposable mitt 10 can be grasped and pulled from the wicket 32 such that the body of the mitt separates from the tear-off portion 26.

As best seen in FIG. 2, the front sheet 12 includes a cuff portion 34 which extends and opens toward the closed end 22 of the mitt 10. The cuff 34 provides an easy and convenient method to open the open end 24 when donning the mitt 10. To open the mitt 10, the fingers of the free hand are inserted between the cuff 34 and the front sheet 12 and the cuff 34 is lifted upwards thereby opening the open end 24 of the mitt 10. Then the user's hand can be inserted easily into the mitt 10.

It can be appreciated that the cuff 34 can be easily grasped by a bare hand or a hand which is already covered by a similar mitt 10. Therefore, the user can quickly put on two mitts in a convenient and hygienic manner.

Thus, the present invention provides a disposable mitt suitable for use in food handling and service industries which is inexpensive to manufacture and convenient to use. Furthermore, the design of the mitt enables the user to put the mitt on either one or both hands in an efficient and hygienic manner. The design of the mitt is suitable for low cost, high volume production and is adapted to be mounted on a wicket for placement near a workstation.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A disposable mitt, comprising:

(a) a mitt body formed of a front layer of plastic sealed to a back layer of plastic around the respective periphery thereof forming a closed end and an open end and forming a portion for the thumb and one or more portions for the fingers of the user;

(b) a detachable section attached to and extending from said back portion adjacent said open end of said mitt body, said detachable portion including a line of weakness suitable for separation of said detachable portion from said mitt body and including means to mount said mitt assembly on a support structure; and (c) a cuff attached to said front layer of said mitt body adjacent said open end thereof, said cuff being open and extending toward said closed end;

(d) whereby said cuff can be grasped by a free hand of the user to enlarge said open end of said mitt body to assist in donning said mitt body either before or after separation of said mitt body from said detachable section.

2. A disposable mitt as in claim 1, wherein:

(a) said cuff is integral and in one piece with said front layer; and (b) said detachable section is integral and in one piece with said back layer.

3. A disposable mitt as in claim 2, wherein said detachable portion includes one or more holes suitable for mounting over a wicket and said line of weakness is intermediate said holes and said mitt body.

* * * * *